US006994574B1

(12) United States Patent
Lai

(10) Patent No.: US 6,994,574 B1
(45) Date of Patent: Feb. 7, 2006

(54) TERMINAL-SELECTIVE CARD CONNECTOR

(75) Inventor: Yaw-Huey Lai, Taipei (TW)

(73) Assignee: Tai-Sol Electronics Co., Lrd., Taipei (TW)

( * ) Notice: Subject to any disclaimer, the term of this patent is extended or adjusted under 35 U.S.C. 154(b) by 0 days.

(21) Appl. No.: 11/202,058

(22) Filed: Aug. 12, 2005

(30) Foreign Application Priority Data

May 30, 2005 (TW) ..... 94208933 U

(51) Int. Cl.
*H01R 13/62* (2006.01)

(52) U.S. Cl. ..... 439/159; 439/347

(58) Field of Classification Search ..... 439/159, 439/347

See application file for complete search history.

(56) References Cited

U.S. PATENT DOCUMENTS 4,984,993 A * 1/1991 Neumann et al. ..... 439/157
6,428,338 B1 * 8/2002 Yasufuku et al. ..... 439/310
6,544,061 B1 * 4/2003 Yasufuku et al. ..... 439/310
6,843,670 B2 * 1/2005 Yamaguchi et al. ..... 439/159
2003/0157839 A1 * 8/2003 Yamaguchi et al. ..... 439/630

* cited by examiner

*Primary Examiner*—Briggette Hammond
*Assistant Examiner*—James R. Harvey
(74) *Attorney, Agent, or Firm*—Bacon & Thomas PLLC

(57) ABSTRACT

A terminal-selective card connector includes a housing, a slide plate, a spring, a slide hood, and an injecting/ejecting device. At least two groups of terminals are mounted inside the housing. The slide plate is longitudinally slidably mounted at an internal lower side of the housing, having a plurality of elongated slots and a first action point located at a rear end thereof. The second group of terminals runs through bottom sides and then top sides of the elongated slots. The spring is mounted inside the housing for keeping forward movement of the slide plate. The slide hood has a second action point and a stopping portion for contacting against an inserted predetermined card. The injecting/ejecting device is mounted inside the housing for working on the slide hood. Thus, selectivity of the terminals is effected to enable different actions while different cards are inserted.

8 Claims, 19 Drawing Sheets

TERMINAL-SELECTIVE CARD CONNECTOR

BACKGROUND OF THE INVENTION

1. Field of the Invention

The present invention relates generally to electronic apparatuses, and more particularly, to a terminal-selective card connector.

2. Description of the Related Art

Referring to FIG. 18, a conventional all-in-one card connector 70 for compatibly accommodating multiple kinds of electronic cards includes a housing 71, several receiving rooms formed inside the housing 71 and partially overlapping for receiving the cards, and many groups of terminals mounted inside the housing 71 for electrical connection respectively with corresponding contact pins of different cards, for the purpose of transitional connection. Referring to FIG. 19, another conventional card connector 80 includes an injecting/ejecting device mounted inside a housing 81 thereof for securing an inserted card at a lockup position for access and then ejecting the card while the card is pushed further again.

However, all of the terminals of each of the aforesaid card connectors extend into the housing, while a card is inserted, the card is subject to interference with incompatible terminals. Some erroneous insertion actions of a card, such as insertion of an upside-down card, may incur short circuit and malfunction of the card connector, or worse, damage of the circuits because metallic parts of one of some cards contact some terminals, or damage of the terminals because of abnormal contact of the terminals.

SUMMARY OF THE INVENTION

The primary objective of the present invention is to provide a terminal-selective card connector, which groups of terminals are selective for electrical contact with specific inserted cards to prevent the cards from short circuit incurred by erroneous insertion of the card to further protect accessible effect of the card connector.

The secondary objective of the present invention is to provide a terminal-selective card connector, which renders different actions while different cards are inserted therein.

The foregoing objectives of the present invention are attained by the terminal-selective card connector, which includes a housing, at least two groups of terminals, a slide plate, a spring, a slide hood, and an injecting/ejecting device. The terminals are mounted inside the housing, defining a first group of terminals and a second group of terminals. The first group of terminals is located at an internal rear end of the housing, having a part elastically bending forkward and upward. The second group of terminals is located at an internal bottom side of the housing, having a part bending upward and backward. The slide plate is longitudinally slidably mounted at an internal lower side of the housing, having a plurality of elongated slots and a first action point. The second group of terminals runs through bottom sides and then top sides of the elongated slots. The first action point is located at a rear end of the slide plate for contacting against an inserted specific card. The spring is mounted inside the housing for keeping forward movement of the slide plate. The slide hood is longitudinally slidably mounted at an internal upper side the housing, having a second action point at a rear end thereof and a stopping portion formed at a predetermined position thereof for contacting against an inserted predetermined card, for defining an injecting position and an ejecting position. The injecting/ejecting device is mounted inside the housing for keeping the slide hood at the injecting position or the ejecting position.

While a card compatible with the first group of terminals is inserted into the card connector, the second group of terminals can be suppressed to avoid contacting metallic parts of the card to further avoid short circuit. While a card compatible with the second group of terminals is inserted into the card connector, the card contacts the second group of terminals. Thus, the present invention enables selectivity of the terminals to cause different actions while different cards are inserted therein.

DETAILED DESCRIPTION OF PREFERRED EMBODIMENTS

Figure 1:
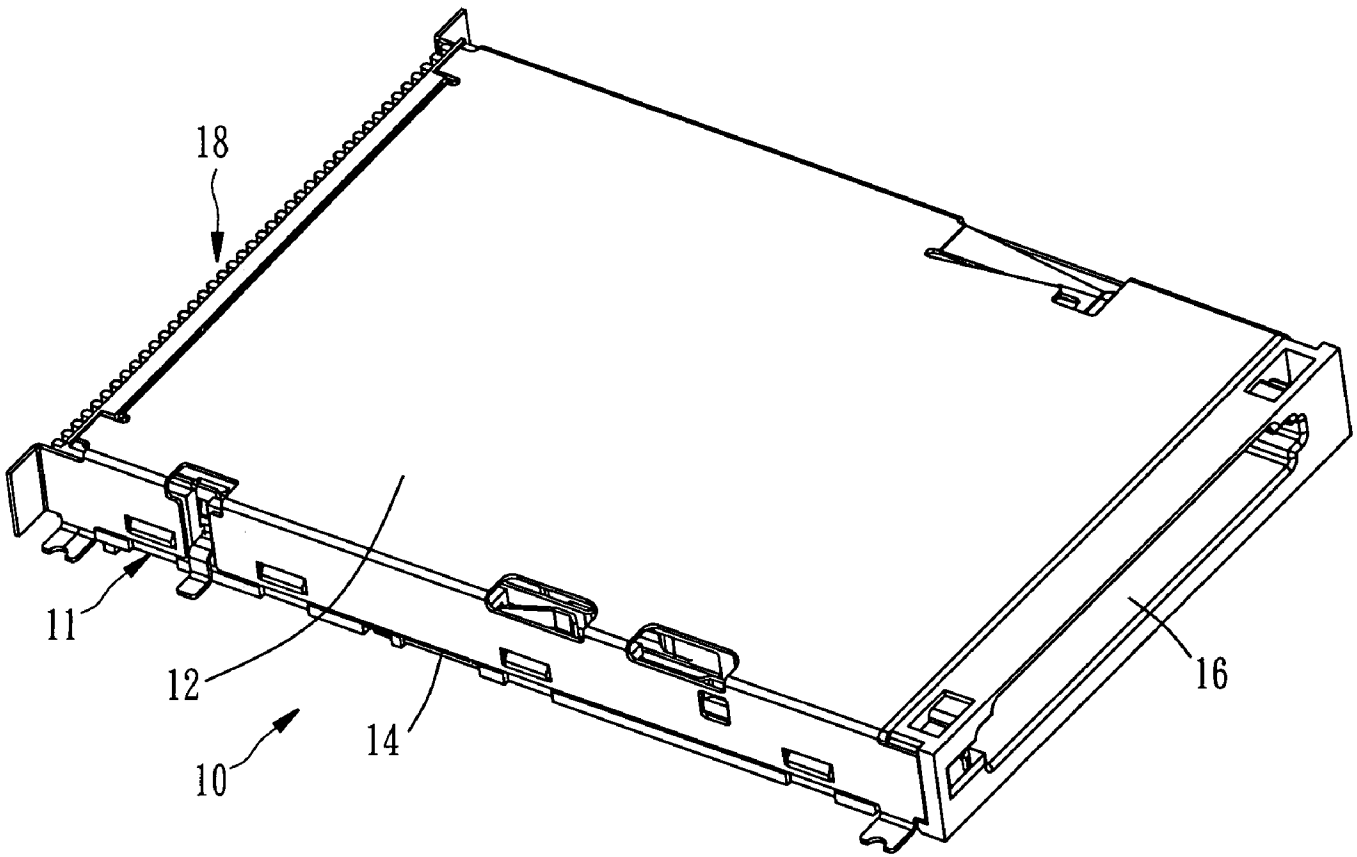
FIG. 1 is a perspective view of a preferred embodiment of the present invention.

Referring to FIGS. 1–4, a card connector 10 constructed according to a preferred embodiment of the present invention is composed of a housing 11, a slide plate 21, a spring 31, a slide hood 41, and an injecting/ejecting device 51.

The housing 11 includes a cover shell 12 and a base frame 14 combined with the cover shell 12, having an opening 16 formed at a front end thereof. At least two groups of terminals 18 are mounted inside the housing 11 and extend into inside space of the housing 11, defining a first group of terminals 181 and a second group of terminals 182. The first group of terminals 181 is located at an internal rear end of the housing 11 for corresponding to an MS card, having a part elastically bending forward and upward. The second group of terminals 182 is located at an internal bottom side of the housing 11 for corresponding to an SD/MMC card, having a part elastically bending backward and upward.

The slide plate 21 is longitudinally slidably mounted at an internal lower side of the housing 11, having a plurality of elongated slots 22 for running through their bottom sides and then their top sides by the terminals of the second group 182, a plurality of suppressing points 24 defined under front ends of the elongated slots 22 for suppressing the elastically bended part of the second group of terminal 182 while the slide plate 21 is slidably moved backward, a first action point 26 defined at a rear end thereof; and an error-action retaining point 27 for corresponding to the MS card, and a hooking member 28 formed at a side thereof.

The spring 31 is mounted between the slide plate 21 and the housing 11 for generating rebounding resilience that keeps forward movement of the slide plate 21. The spring 31 has a predetermined length for keeping the slide plate 21 away from the housing 11 for a predetermined distance.

The slide hood 41 is longitudinally slidably mounted at an internal upper side of the housing 11 and stacked upon the slide plate 21, having a second action point 42 defined at a rear end thereof for corresponding to the MS card. The slide hood 41 includes a stopping portion 44 formed at a predetermined position thereof for corresponding to the SD/MMC card.

The injecting/ejecting device 51 is mounted inside the housing 11 for keeping the slide hood 41 at a lockup injecting or ejecting position. Because the injecting/ejecting device 51 is operationally and structurally the same as the prior art, no further recitation is necessary.

Figure 2:
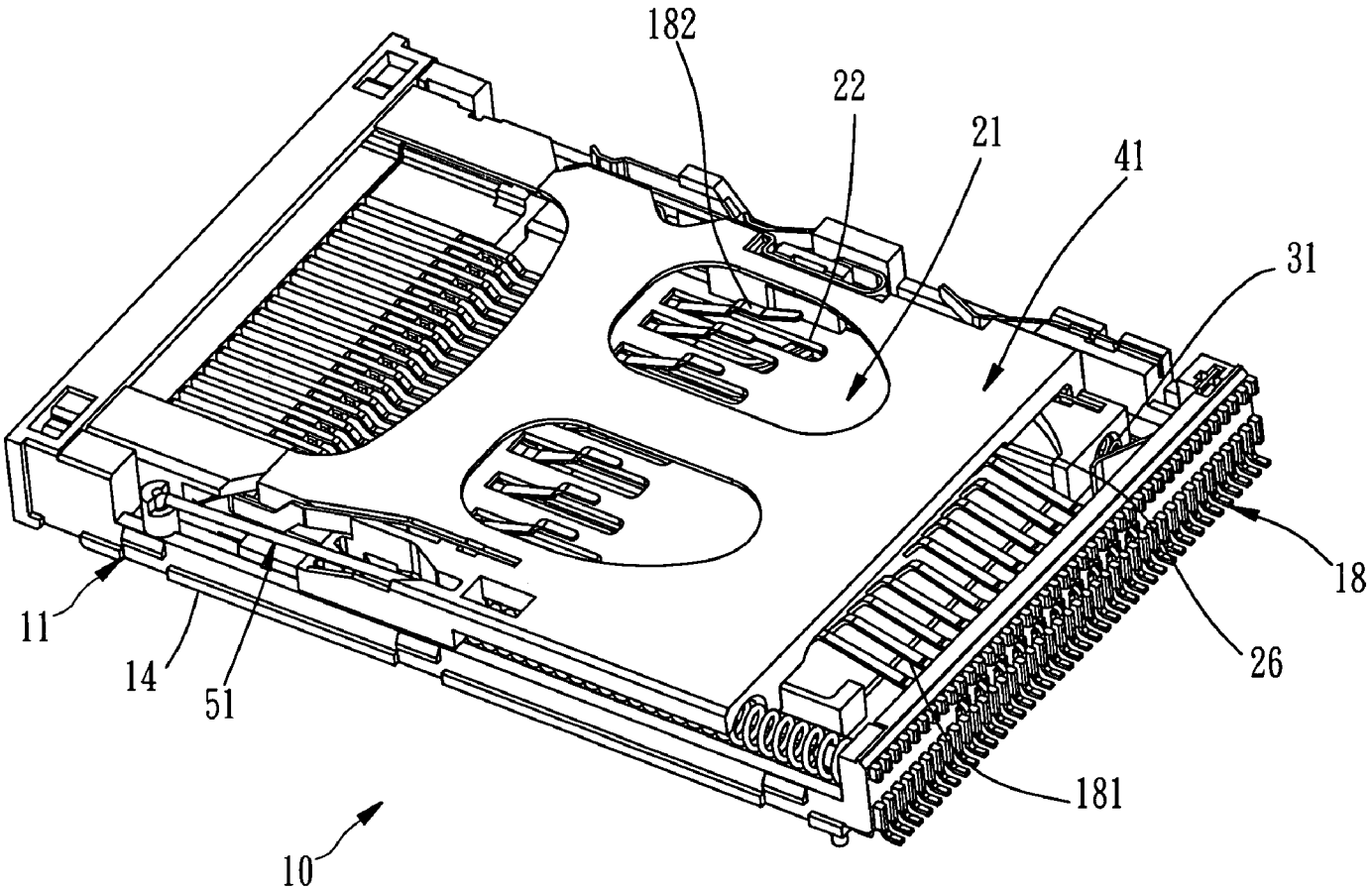
FIG. 2 is another perspective view of the preferred embodiment of the present invention, from which a cover shell is removed.
Figure 3:
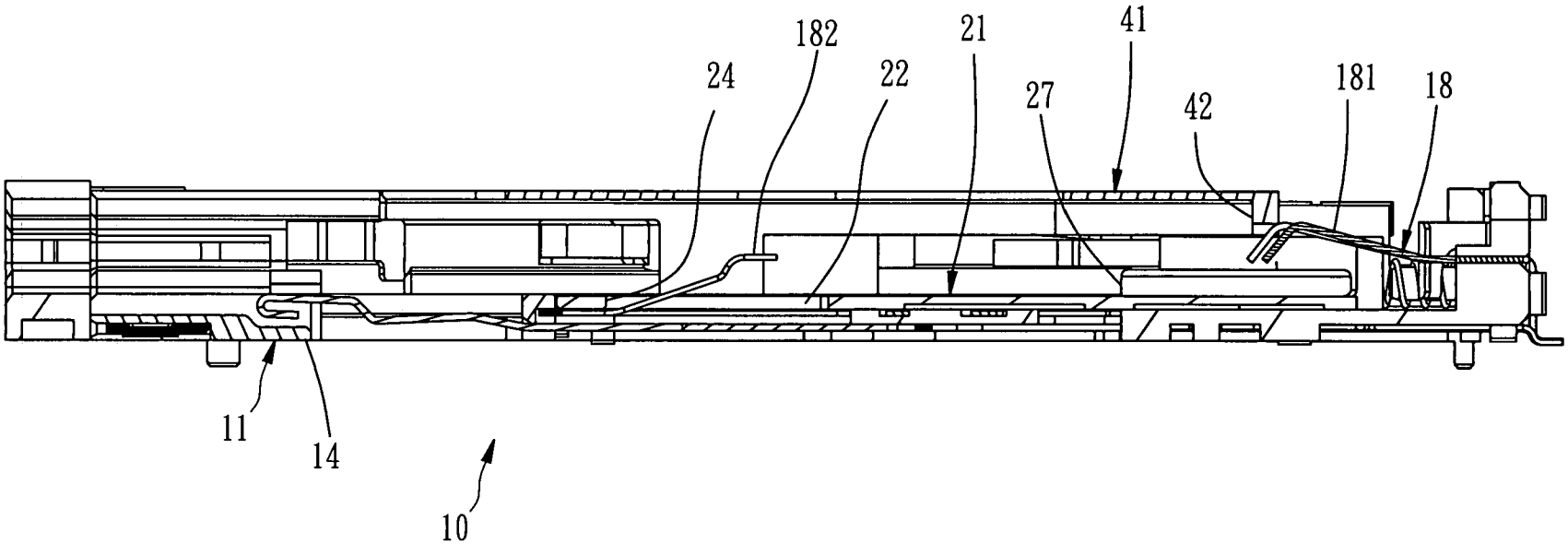
FIG. 3 is a sectional view of FIG. 2.
Figure 4:
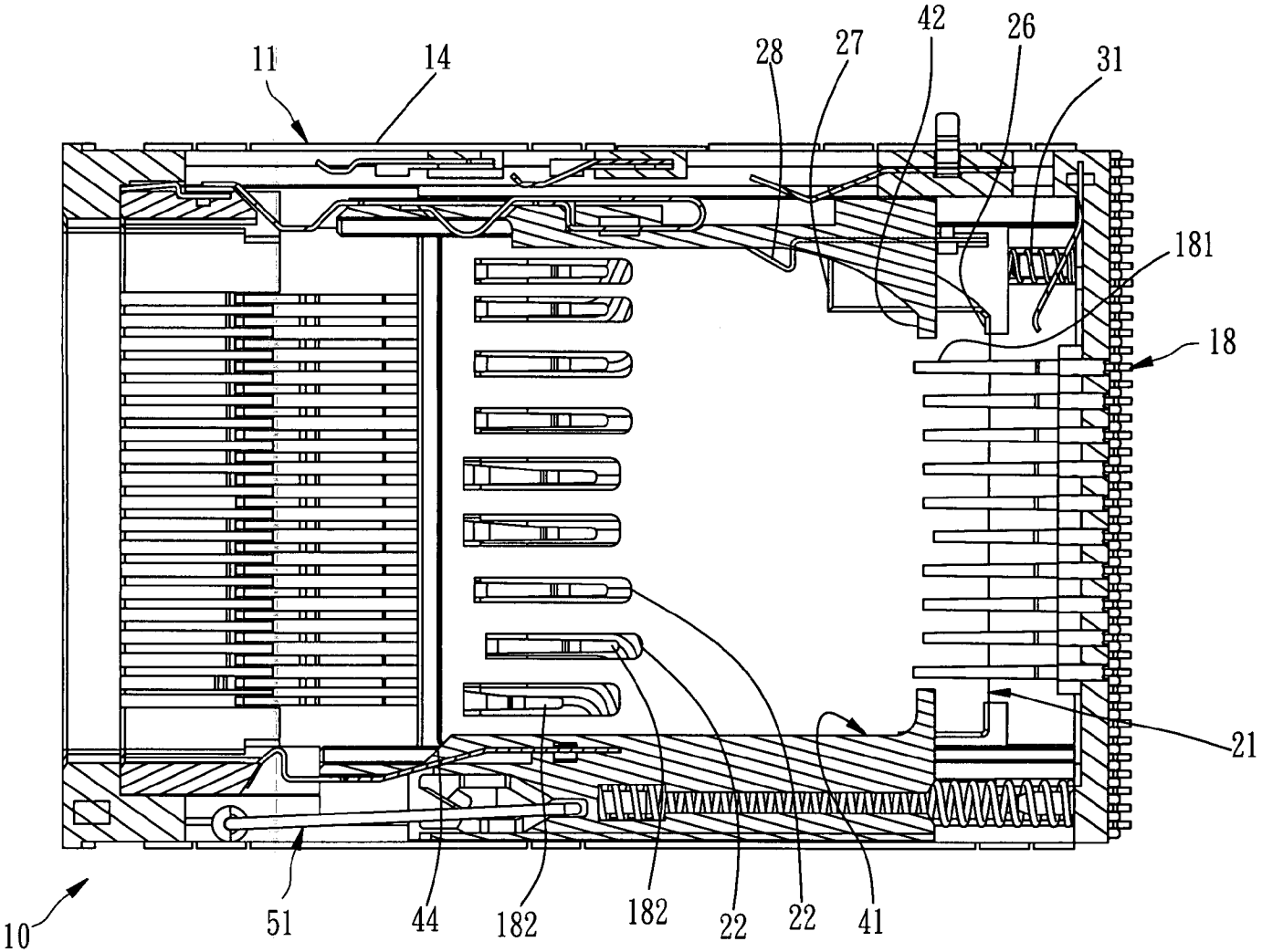
FIG. 4 is a partial top view of the preferred embodiment of the present invention, from which a cover shell is removed.
Figure 5:
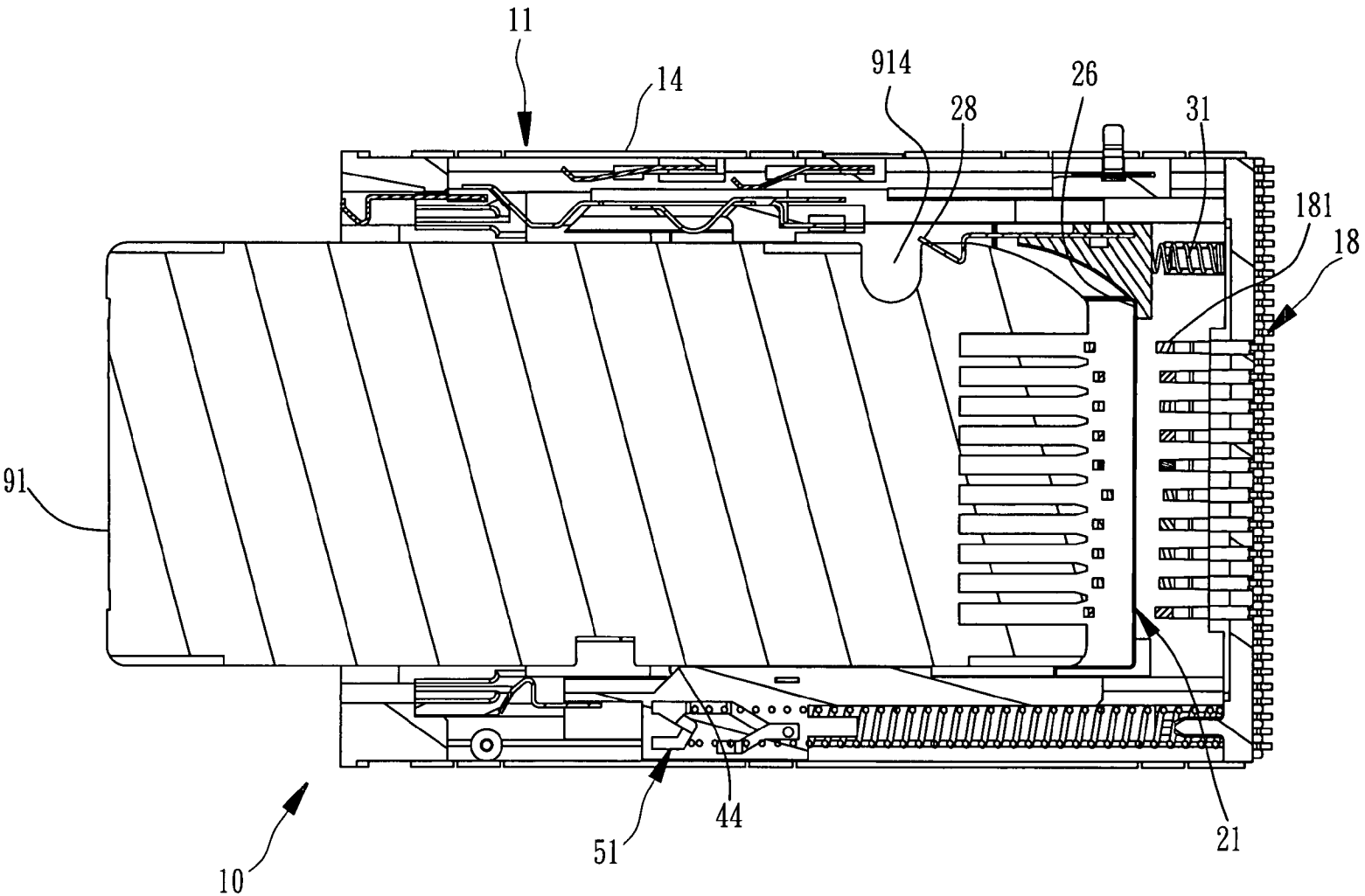
FIG. 5 is similar to FIG. 4, showing that an MS (Memory Stick) card is inserted into the card connector.
Figure 6:
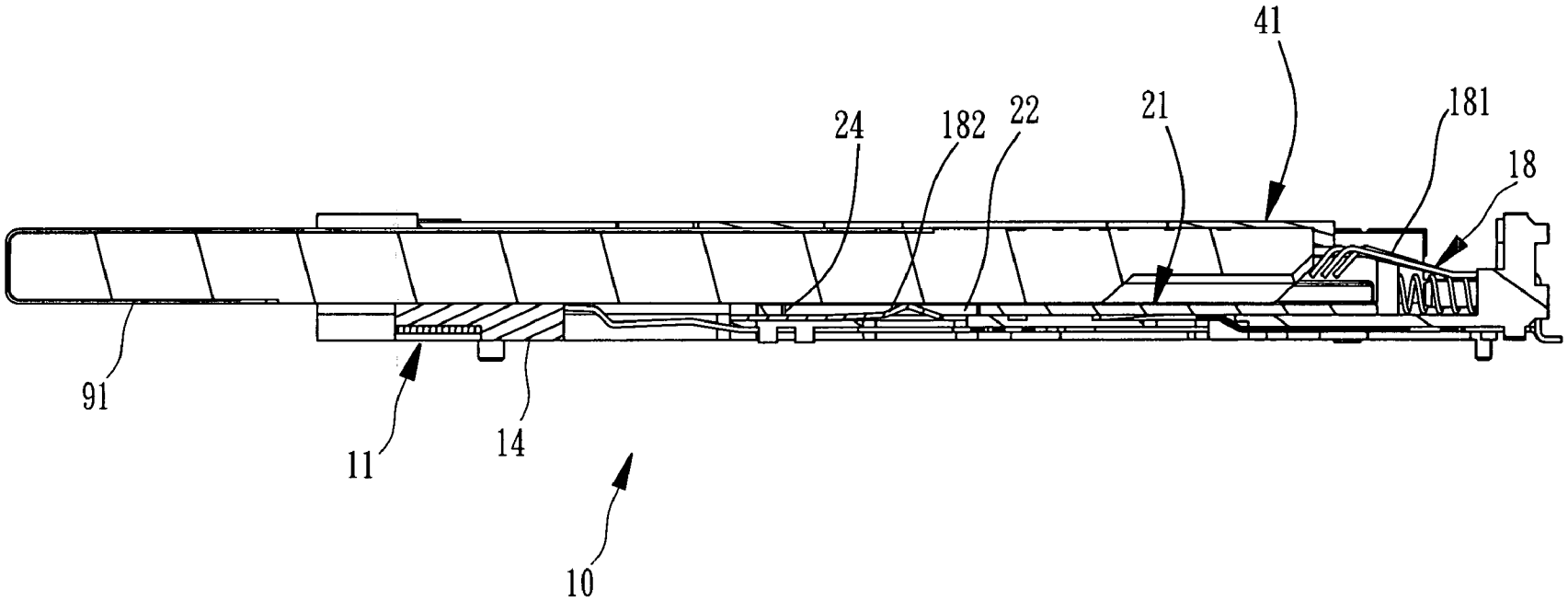
FIG. 6 is a sectional view of FIG. 5.
Figure 7:
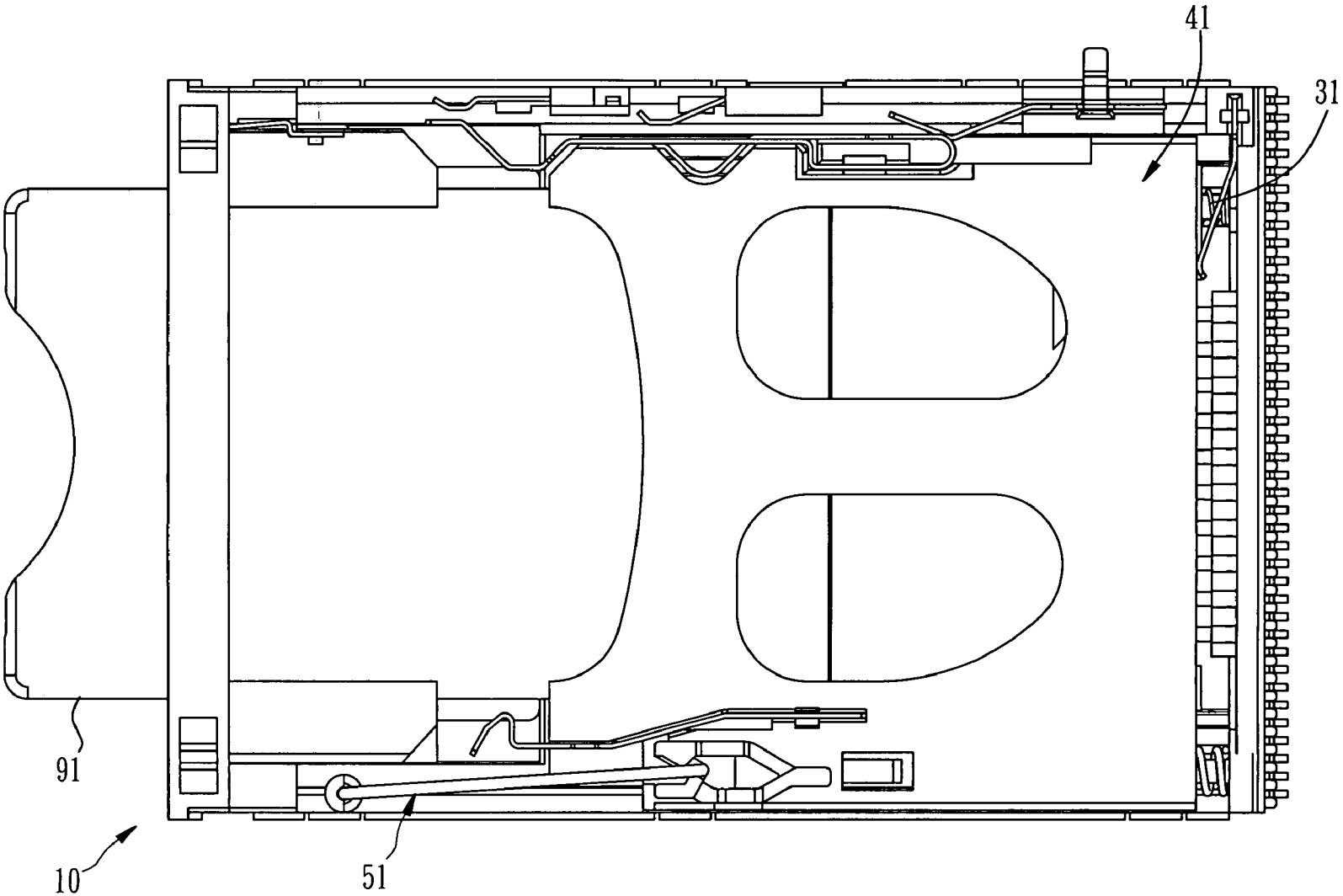
FIG. 7 is a schematic view of the preferred embodiment of the present invention at action, showing that the MS card is inserted to an injecting position.
Figure 8:
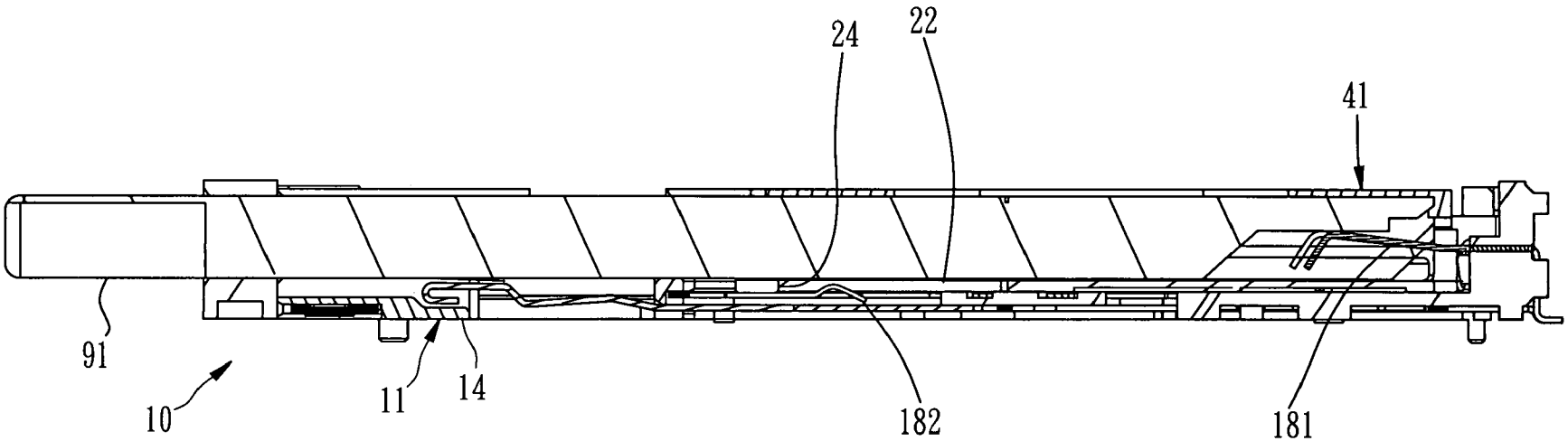
FIG. 8 is a sectional view of FIG. 7.
Figure 9:
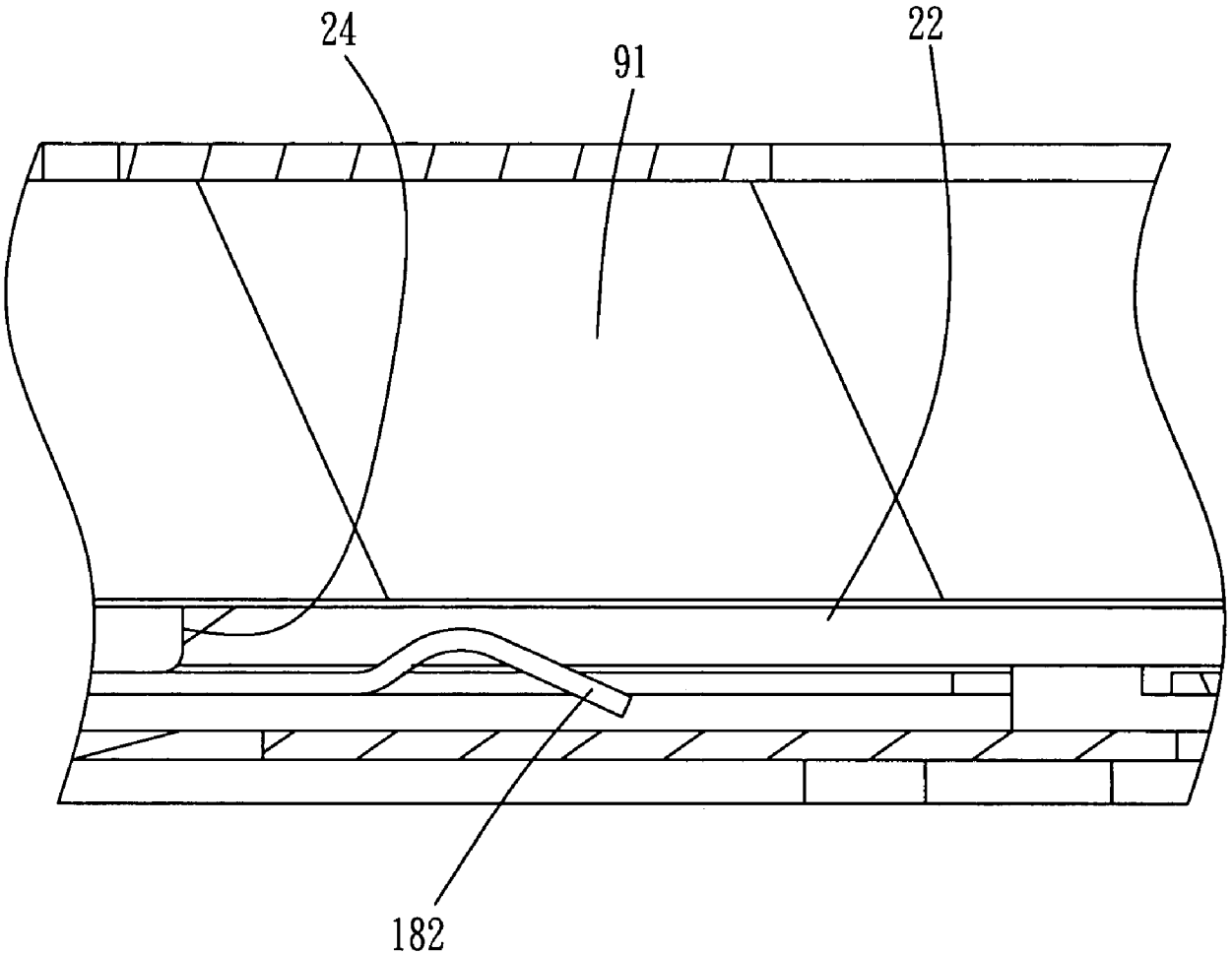
FIG. 9 is a partial enlarged view of FIG. 8.
Figure 10:
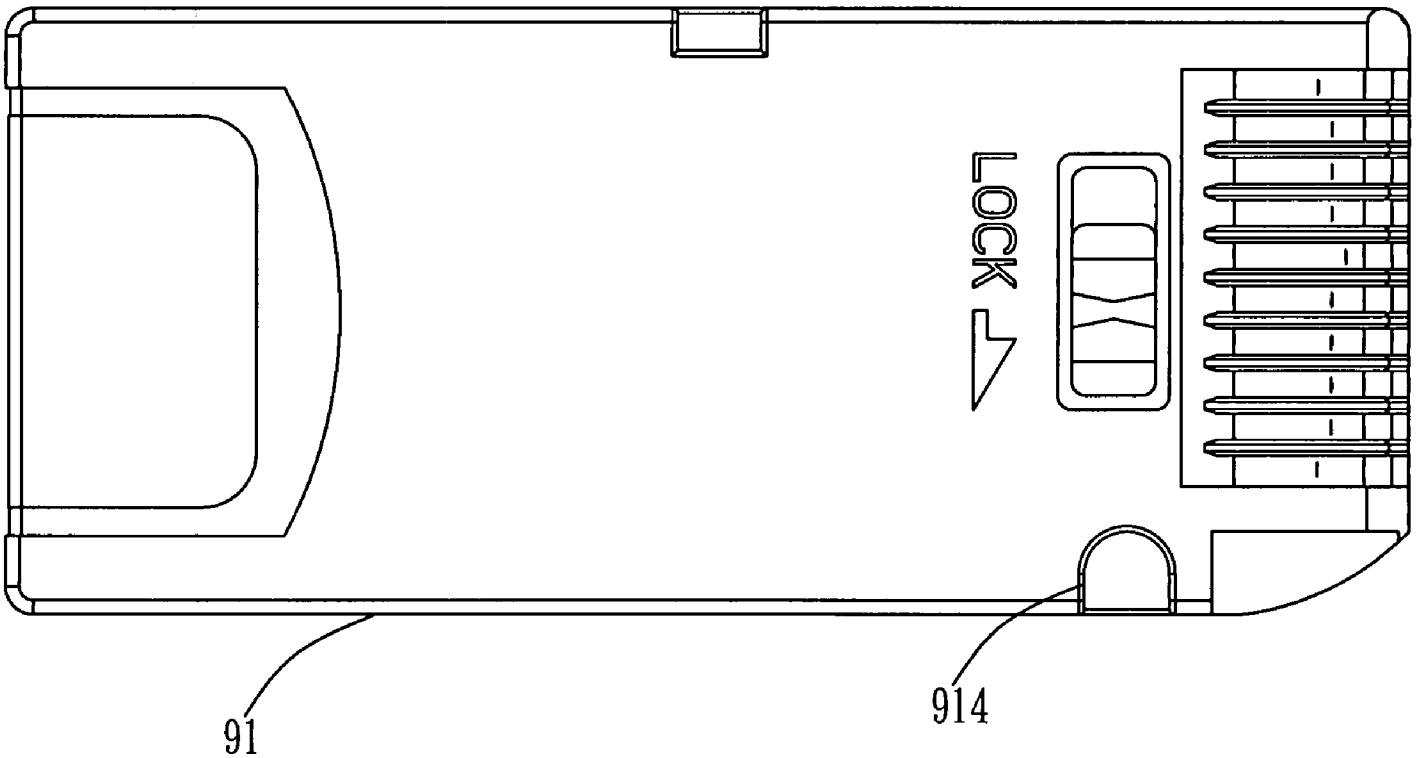
FIG. 10 is a bottom view of the MS card.

FIGS. 2–4 show that none of any card is inserted into the card connector 10.

While an MS card 91 having a recess 914 is inserted into the card connector 10, as shown in FIGS. 5–10, a front edge of the MS card 91 contacts against the first and second action points 26 and 42 to push the slide plate 21 and the slide hood 41 backward. While the slide plate 21 is moved backward, the suppressing points 24 work on the bended part of the second group of terminals 182 to suppress the bended part; meanwhile, the MS card does not touch the second group of terminals 182 while moved further inward from a position shown in FIG. 6 to another position shown in FIG. 8. While moved backward, the slide hood 41 works on the injecting/ejecting device 51 to enable the injecting/ejecting device 51 to keep the slide hood 41 at the injecting position; meanwhile, the MS card 91 is under upward resilience generated by the first group of terminals 181 to be held to the slide hood 41 in a lockup position. Because the holding force of the first group of terminals 181 is greater than the rebounding resilience of the spring 31, the spring 31 fails to push the slide plate 21 outward.

Figure 11:
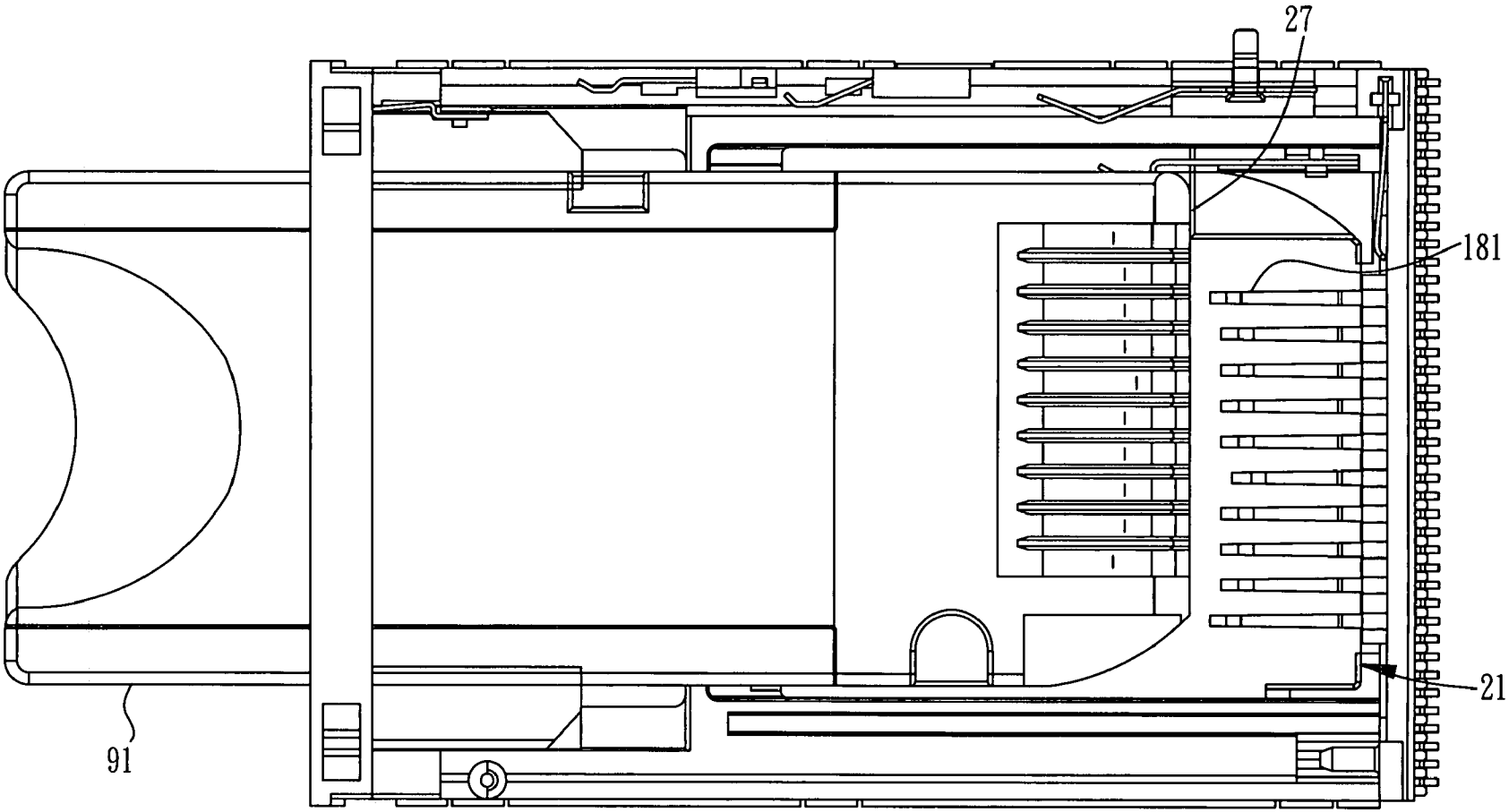
FIG. 11 is similar to FIG. 4, showing that the MS card is reversely inserted into the card connector.
Figure 12:
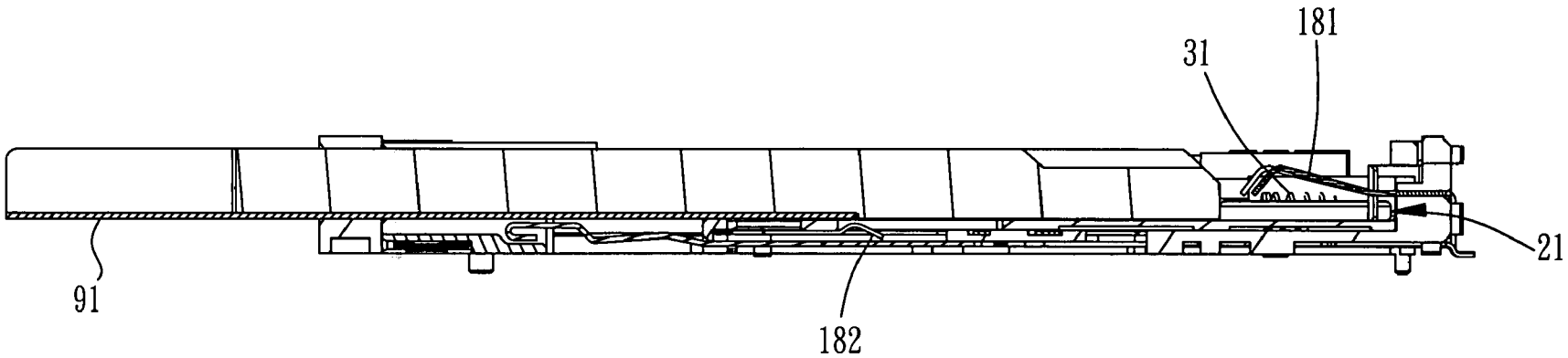
FIG. 12 is a sectional view of FIG. 11.
Figure 13:
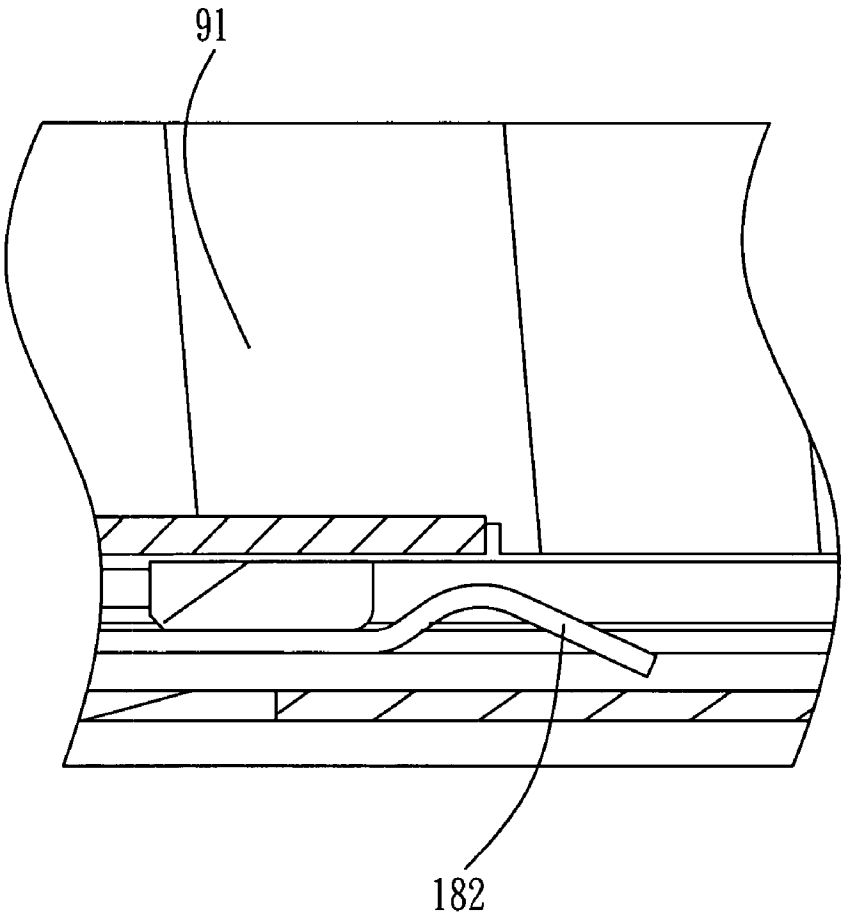
FIG. 13 is a partially enlarged view of FIG. 12.

Because the hooking member 28 can work on the recess 914 of the MS card 91, while the user accidentally draws the MS card 91 outward, the slide plate 21 can be moved forward to the ejecting position to prevent the second group of terminals 182 from suppression and to avoid an error action incurred by an inserted SD/MMC card 92 failing to contact the second group of terminals 182. If the user mistakenly inserts the MS card 91 into the card connector 10; for example, the MS card 91 is reversely inserted, as shown in FIGS. 11–13; the upside-down MS card 91 works on the error-action retaining point 27 to move the slide plate 21 backward to suppress the second group of terminals 182 to further prevent the second group of terminals 182 from touching metallic parts located on an overside of the MS card 91 and to avoid short circuit. In addition, the error-action retaining point 27 prevents a mistakenly inserted card from impacting the first group of terminals 181. Further, while withdrawing the mistakenly inserted MS card 91, the spring 31 can keep the slide plate 21 moving to the ejecting position to securely keep the second group of terminals 182 from suppression and to keep the second group of terminals 182 for normal function while an SD card is inserted, further avoiding another error action.

While withdrawing the MS card 91 is wanted, the user can merely push the MS card inward again to enable the injecting/ejecting device 51 to get rid of the lockup injecting position to be moved toward the ejecting position. In the meantime, the slide hood 41 and the slide plate 21 are moved forward. After the slide plate 21 is moved forward for a predetermined distance, the second group of terminals 182 is no longer suppressed by the suppressing points 24 to be elastically bended and then the MS card 91 is also withdrawn for a predetermined distance, thus effecting selectivity of the terminals.

Figure 14:
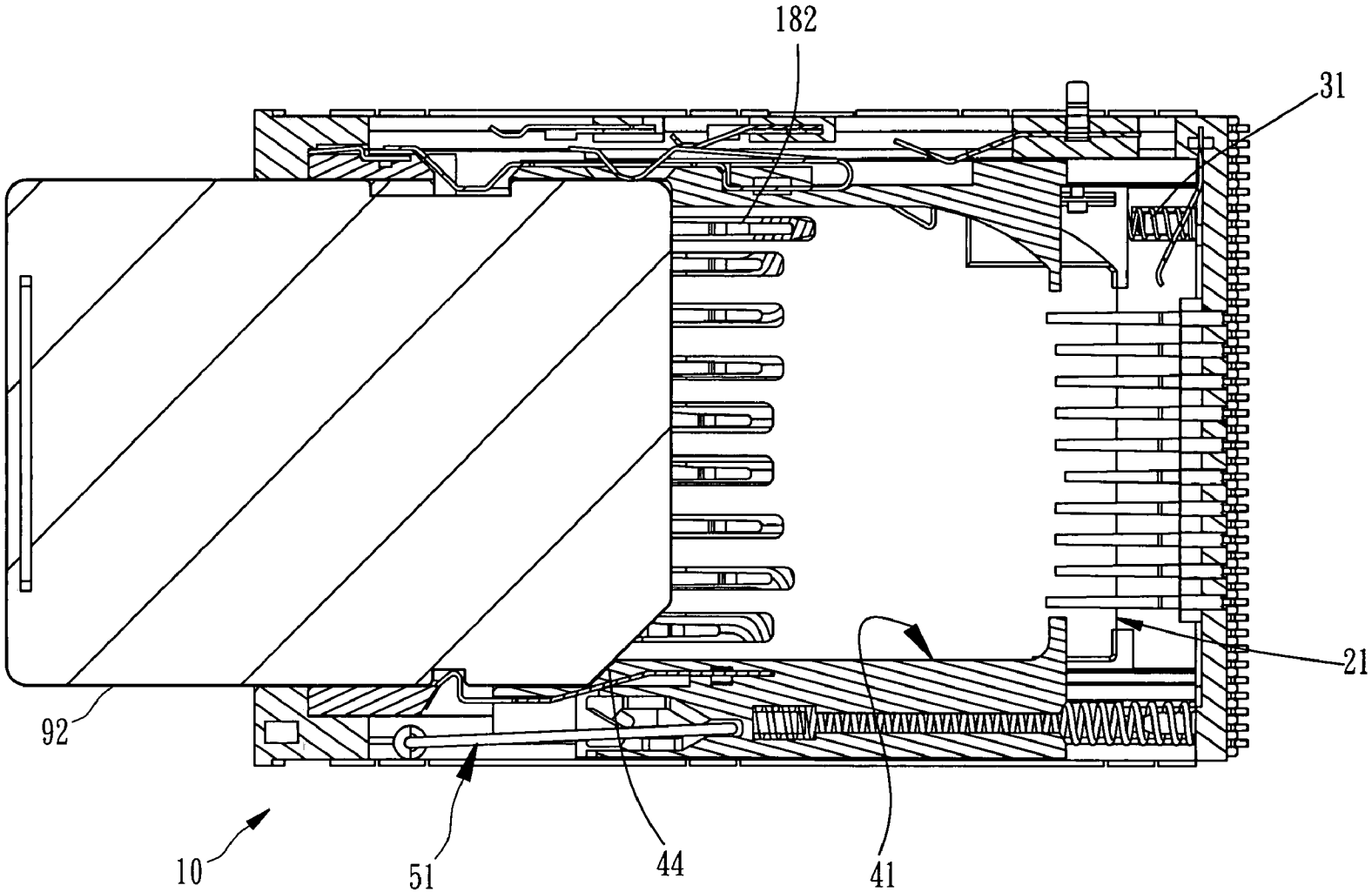
FIG. 14 is similar to FIG. 4, showing that an SD/MMC (Secure Digital/Multi Media Card) card is inserted into the card connector.
Figure 15:
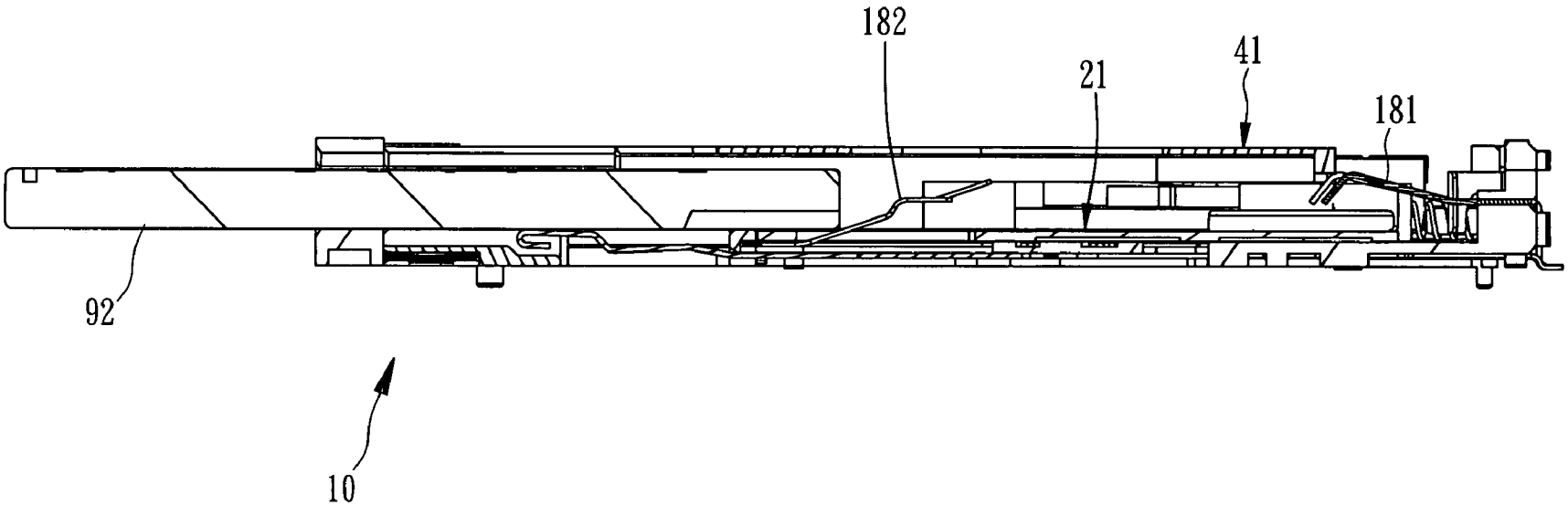
FIG. 15 is a sectional view of FIG. 14.
Figure 16:
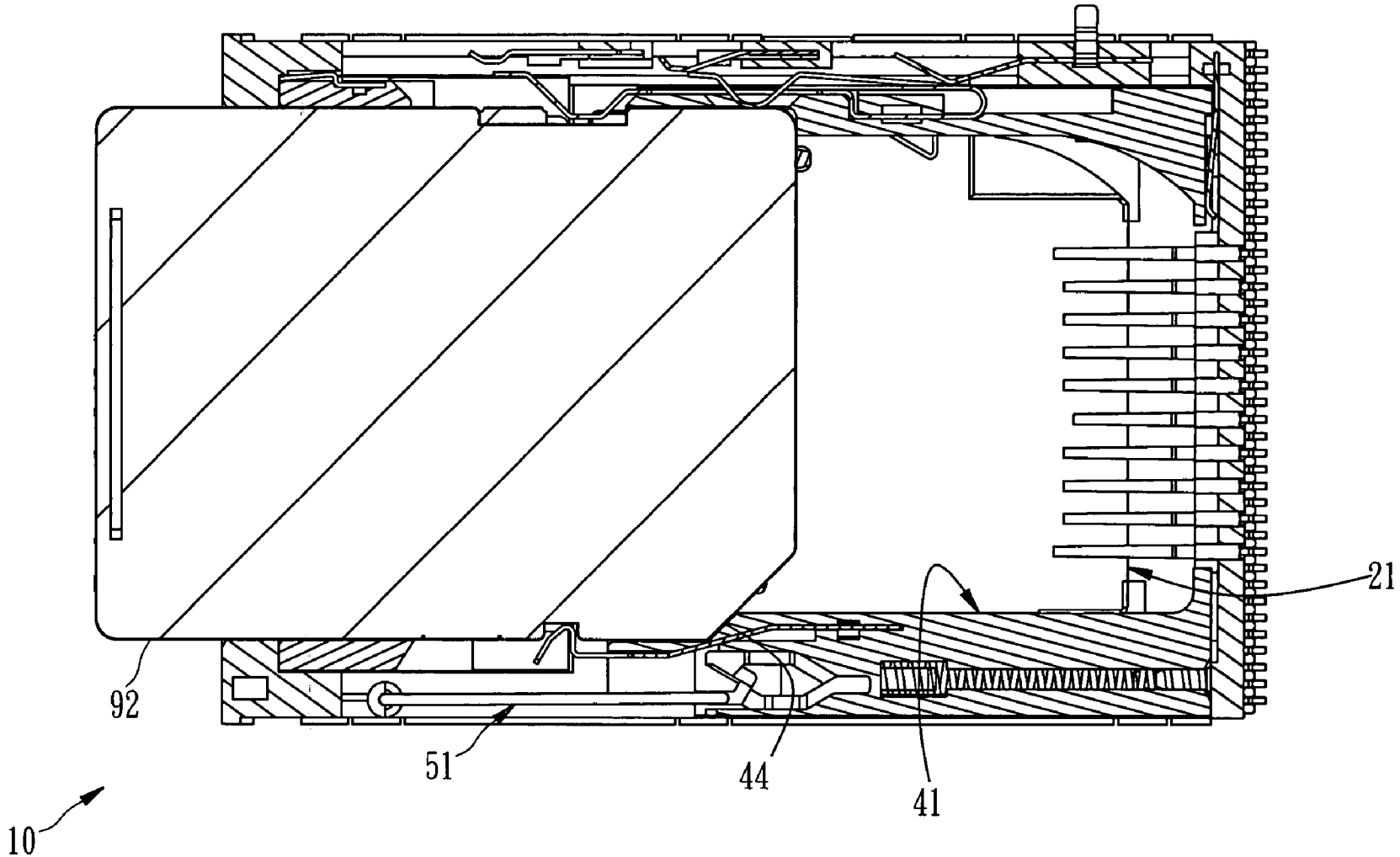
FIG. 16 is another schematic view of the preferred embodiment of the present invention at action, showing that the SD/MMC card is inserted into a injecting position.
Figure 17:
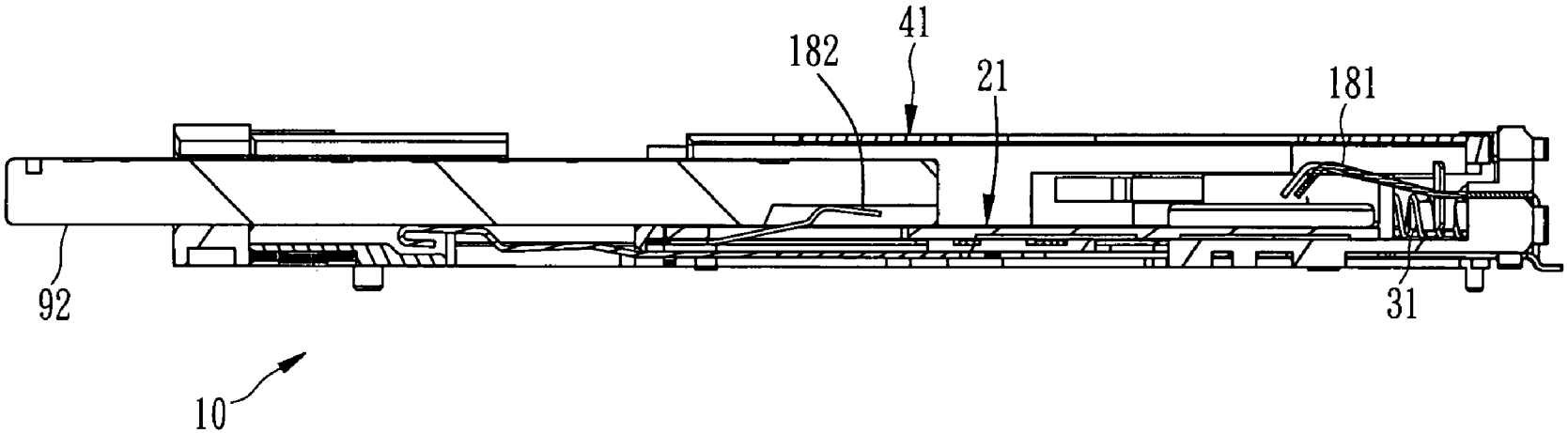
FIG. 17 is a sectional view of FIG. 16.
Figure 18:
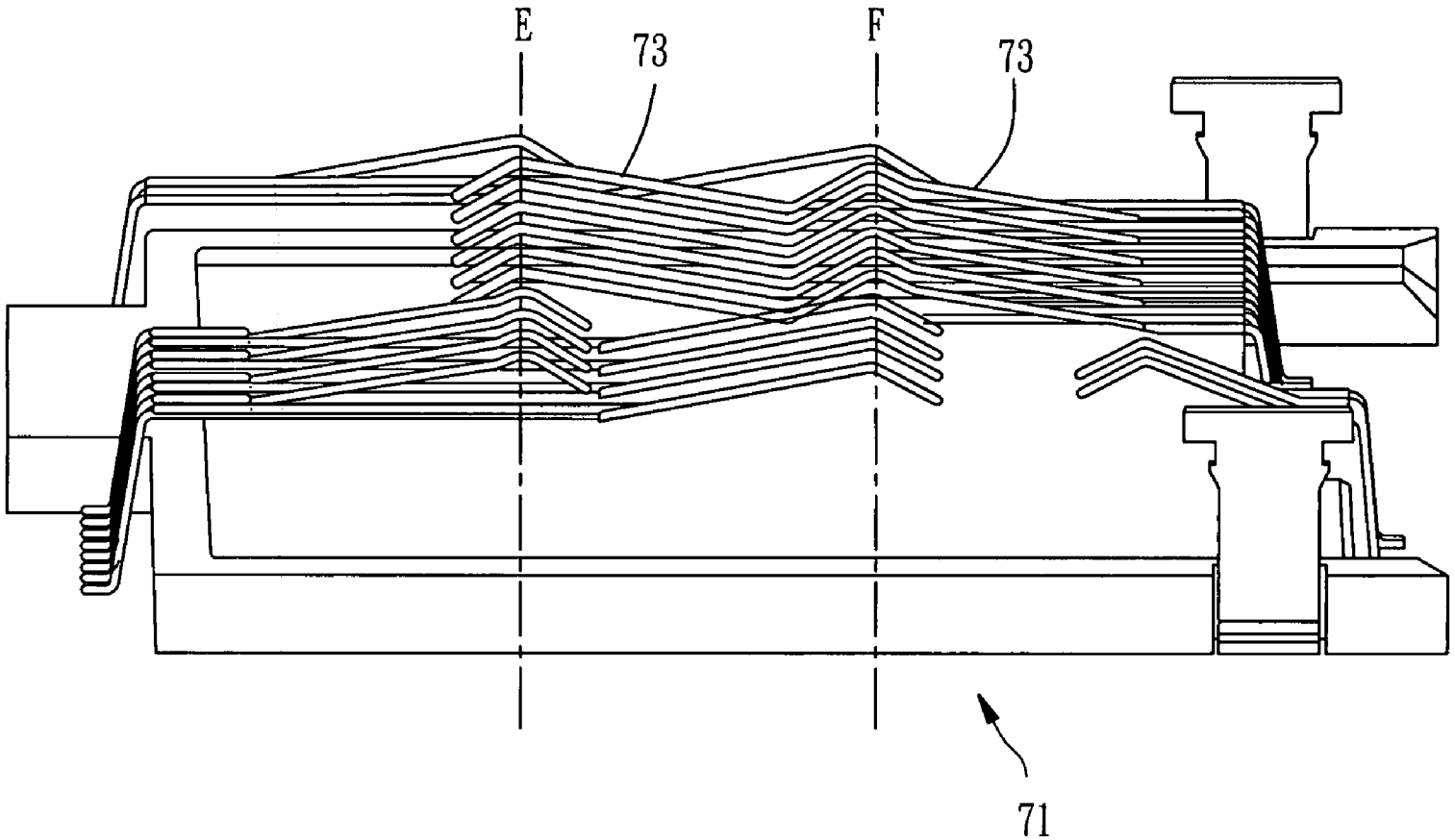
FIG. 18 PRIOR ART
FIG. 18 shows a conventional card connector.
Figure 19:
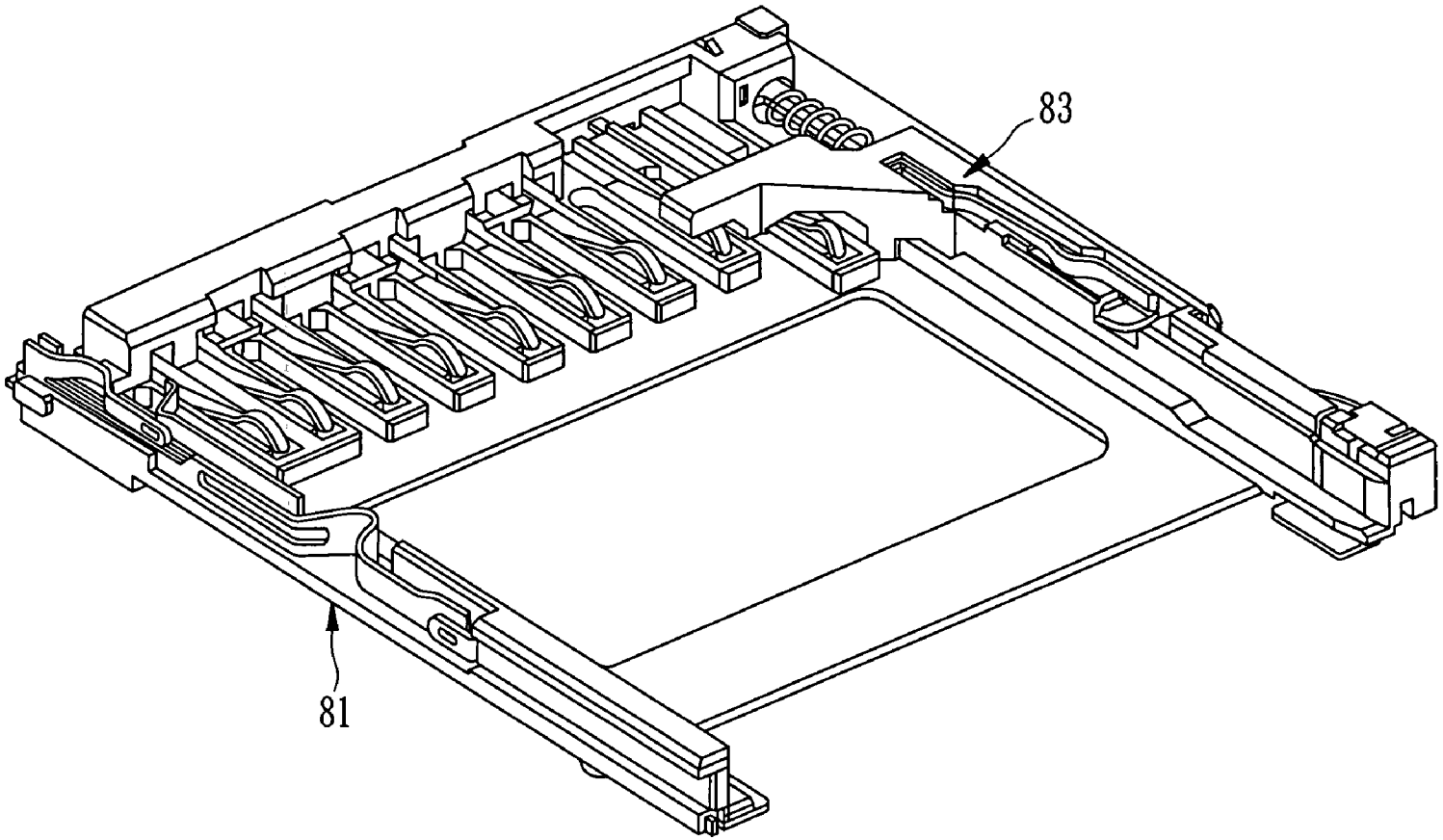
FIG. 19 PRIOR ART
FIG. 19 shows a conventional card connector.

Referring to FIGS. 14–15, while inserted into the card connector 10, the SD/MMC card 92 works on the stopping portion 44 to directly push the slide hood 41 into the injecting position and to enable the injecting/ejecting device 51 to keep the slide hood 41 at the lockup injecting position, as shown in FIGS. 16–17. In the meantime, the slide plate 21 is not moved, such that the second group of terminals 182 is not suppressed by the slide plate 21 to be allowed contacting the SD/MMC card 92. In addition, the resilience of the spring 31 can securely keep the slide plate 21 from accidental backward movement enabling the second group of terminals 182 to be accidentally suppressed. While withdrawing the SD/MMC card 92 is wanted, the user can merely push the SD/MMC card 92 again to enable the injecting/ejecting device 51 to move the slide hood 41 forward to the ejecting position and to enable the stopping portion 44 to push the SD/MMC card 92 to the ejecting position.

In conclusion, the present invention includes the following advantages. The slide plate 21 can suppress a specific group of the terminals to attain the terminal-selective purpose. The slide plate 21 accommodates the MS card 91 for suppressing the second group of terminals 182 corresponding to the SD/MMC card 92 to prevent the second group of terminals 182 from short circuit incurred by contacting either the metallic parts located on a bottom side of the MS card 91 or the metallic parts located on the overside of the MS card 91 reversely inserted, further securing effective access of the card connector 10. The slide hood 41 can enable the injecting/ejecting device 51 to accommodate the MS card 91 and the SD/MMC card 92 for corresponding actions, thus effecting different actions while different cards are inserted into the card connector. In addition, if the cover shell 12 is made of metal, the slide hood 41 can prevent the second group of terminals 182 from short circuit incurred by its overly bended part contacting the cover shell 12.

It is to be noted that the MS card 91 and SD/MMC card 92 in the embodiment of the present invention are for examples only but not limited thereto, and any other electronic cards structurally similar to the MS and SD/MMC cards 91 and 92 are included within the scope of the present invention.

What is claimed is:

1. A terminal-selective card connector comprising:

a housing having an opening formed at a front end thereof and at least two groups of terminals mounted in said housing and extending into inside space of said housing, said terminals defining a first group of terminals and a second group of terminals, said first group of terminals being located at an internal rear end of said housing and having a part elastically bending forkward and upward, said second group of terminals being located at an internal bottom side of said housing and having a part elastically bending backward and upward;

a slide plate longitudinally slidably mounted at an internal lower side of said housing, said slide plate having a plurality of elongated slots and a first action point, said terminals of the second group running through bottom sides and then top sides of said elongated slots, said first action point being located at a rear end of said slide plate;

a spring mounted between said slide plate and said housing for generating resilience that keeps forward movement of said slide plate;

a slide hood longitudinally slidably mounted at an internal upper side of said housing, said slide hood having a second action point defined at a rear end thereof and a stopping portion defined at a predetermined position thereof; and an injecting/ejecting device mounted inside said housing and working on said slide hood for keeping said slide hood at an injecting or ejecting position.

2. The card connector as defined in claim 1, wherein said slide plate includes a hooking member.

3. The card connector as defined in claim 1, wherein said housing includes a base frame and a cover shell combined with said base frame.

4. The card connector as defined in claim 1, wherein said slide plate includes a suppressing point defined under a front end of each of said elongated slots.

5. The card connector as defined in claim 1, wherein said first group of terminals accommodates an MS (Memory Stick) card, and said second group of terminals accommodates an SD/MMC (Secure Digital/Multi Media Card) card.

6. The card connector as defined in claim 1, wherein said first and second action points accommodate an MS card, and said stopping portion accommodates an SD/MMC card.

7. The card connector as defined in claim 1, wherein said slide hood and said slide plate are stacked upon each other.

8. The card connector as defined in claim 1, wherein said slide plate includes an error-action retaining point defined at a rear end thereof.

* * * * *